US005747760A

United States Patent [19]

Skarivoda

[11] Patent Number: 5,747,760

[45] Date of Patent: May 5, 1998

[54] TIMER WITH IMPROVED GENEVA DRIVE MECHANISM

[75] Inventor: Edwin L. Skarivoda, Manitowoc, Wis.

[73] Assignee: Paragon Electric Company, Inc., Two Rivers, Wis.

[21] Appl. No.: 678,073

[22] Filed: Jul. 10, 1996

[51] Int. Cl.[6] ..... H01H 7/00; H01H 43/00

[52] U.S. Cl. ..... 200/38 R; 200/37 R; 200/38 A

[58] Field of Search ..... 74/116, 122–125, 74/435–437; 200/33 R, 35 R, 36–35 W, 33 B; 307/141, 141.4, 141.8; 368/97, 98, 101, 106, 107–113, 124–125, 145–146, 184–185, 190

[56] References Cited

U.S. PATENT DOCUMENTS

| | | | |
|---|---|---|---|
| 3,472,976 | 10/1969 | Hunt | 200/38 |
| 3,699,278 | 10/1972 | Jones et al. | 200/38 R |
| 3,725,617 | 4/1973 | Boyles et al. | 200/38 FB |
| 3,745,852 | 7/1973 | Robinson | 74/436 |
| 3,924,399 | 12/1975 | Robinson | 58/16 D |
| 3,991,289 | 11/1976 | Weber | 200/38 FA |
| 4,123,915 | 11/1978 | Stoor | 62/234 |
| 4,311,059 | 1/1982 | Wagle | 47/116 |
| 4,311,886 | 1/1982 | Rulseh | 200/38 R |
| 4,327,259 | 4/1982 | Schuder et al. | 200/38 A |
| 4,466,310 | 8/1984 | Rulseh | 74/665 GA |
| 4,498,788 | 2/1985 | Grimmer et al. | 368/106 |
| 4,500,212 | 2/1985 | Wojtanek | 368/108 |
| 4,595,808 | 6/1986 | Antonuzzi et al. | 200/37 R |
| 4,599,499 | 7/1986 | Duve | 200/35 R |
| 4,755,635 | 7/1988 | Willingman | 200/35 R |
| 4,822,964 | 4/1989 | Koch | 200/303 |
| 5,329,082 | 7/1994 | Saarem | 200/38 D |

*Primary Examiner*—Cassandra C. Spyrou
*Assistant Examiner*—Michael A. Friedhofer
*Attorney, Agent, or Firm*—Foley & Lardner

[57] ABSTRACT

An electrical timer is provided having an electrical motor connected to a first geneva drive gear via a gear train. The geneva drive gear engages a geneva wheel and is coupled to a cam via a clutch joining the geneva wheel and the cam. The clutch may provide a plurality of indexable operating positions wherein each operating position is angularly displaced from adjacent operating positions by a distance equal to the angular distance between adjacent cusps.

19 Claims, 10 Drawing Sheets

TIMER WITH IMPROVED GENEVA DRIVE MECHANISM

FIELD OF THE INVENTION

This invention related generally to cam-actuated timers. More particularly, it relates to cam-actuated timers with geneva mechanisms for varying the motion of the cam.

BACKGROUND OF THE INVENTION

Timers, especially electrical timers, have incorporated cams for actuating switches. Many of these timers have included geneva mechanisms for varying the motion of the cam, allowing it to stop periodically between switch actuations. Some timers allow the cam to be manually indexed with respect to the geneva mechanism to test the timer. In many timers, however, manual operation of the cam cannot be permitted to vary, since manual indexing would get the cam and the geneva mechanism out of sync. In other words, switch events that should occur in a single motion cycle would occur in different motion cycles. Furthermore, manual rotation of the cam may exert significant forces on the geneva drive gear. A timer that preserves the synchronization of the cam and its geneva drive mechanism while allowing the cam to be indexed is desired. Furthermore, a timer that prevents the applied force from deforming the geneva drive mechanism is also desired.

SUMMARY OF THE INVENTION

The subject invention is provided to remedy these and other shortcomings in the prior art, and is directed generally to an electrical timer with a geneva gear coupled to a cam for actuating a plurality of switch contacts.

In accordance with the first embodiment of the invention, an electrical timer is provided having an electrical motor, a gear train coupled to the electrical motor with a plurality of gears including first geneva drive gear, a geneva wheel with a plurality of cusps spaced a first angular distance apart and coupled to the gear train, a cam with a cam actuating surface, and a clutch coupling the geneva wheel to the cam. This clutch may provide a plurality of indexable operating positions, and each of these positions may be angularly displaced from adjacent ones by a second angular distance equal to an integral multiple of the first angular distance. The geneva wheel clutch and cam may have a common rotational axis, and the clutch may include a plurality of flexible arms integrally connected to the geneva wheel that engage a plurality of detents circumferentially disposed about a recess in the cam. The number of indexable operating positions may equal the number of cusps on the geneva wheel. A thrust bearing may also be coupled to the geneva drive gear. The timer may also have a plurality of switch members adapted to be actuated by the cam actuating surface. The cam actuating surface may have a first formation adapted to successively bias the plurality of switch members in first and second biasing events. These biasing events may occur in a single motion cycle of the geneva wheel. The electrical timer may also have a first housing containing the motor and gear train, a second housing containing the geneva wheel cam and the clutch and an intermediate plate adapted to enclose the first housing and second housing and a thrust bearing coupled to the geneva drive gear and rotationally supported by the intermediate plate.

In accordance with the second embodiment of the invention, a switch is provided comprising a geneva wheel with a rotational axis that is adapted to rotate about the axis in a plurality of motion cycles separated by stationary periods, a cam coupled to the geneva wheel, and a single-pole, double-throw switch adapted to be actuated by the cam. The cam and the geneva wheel may have the same rotational axis and rotate at the same instantaneous speed. The cam may be rotatably and indexably advanceable with respect to the geneva wheel and a rotatable index interval equal to the angular displacement of the geneva wheel in a single motion cycle. The switch may be twice thrown during one of the plurality of motion cycles. The two switch throws may be actuated by a single formation on the cam. The switch may not be thrown during any other of the plurality of motion cycles. The switch may further include a clutch with a rotational axis and adapted to couple the geneva wheel in the cam. The clutch may include a plurality of flexible fingers disposed about the clutch's rotational axis and a plurality of teeth adapted to engage the plurality of flexible fingers. The angular displacement between these teeth may be equal to the angular displacement of a single geneva motion cycle. The clutch may have the same rotational axis as the geneva wheel rotational axis.

Other principal features and advantages of the invention will become apparent to those skilled in the art upon review of the following drawings, the detailed description and the appended claims.

Figure 1:
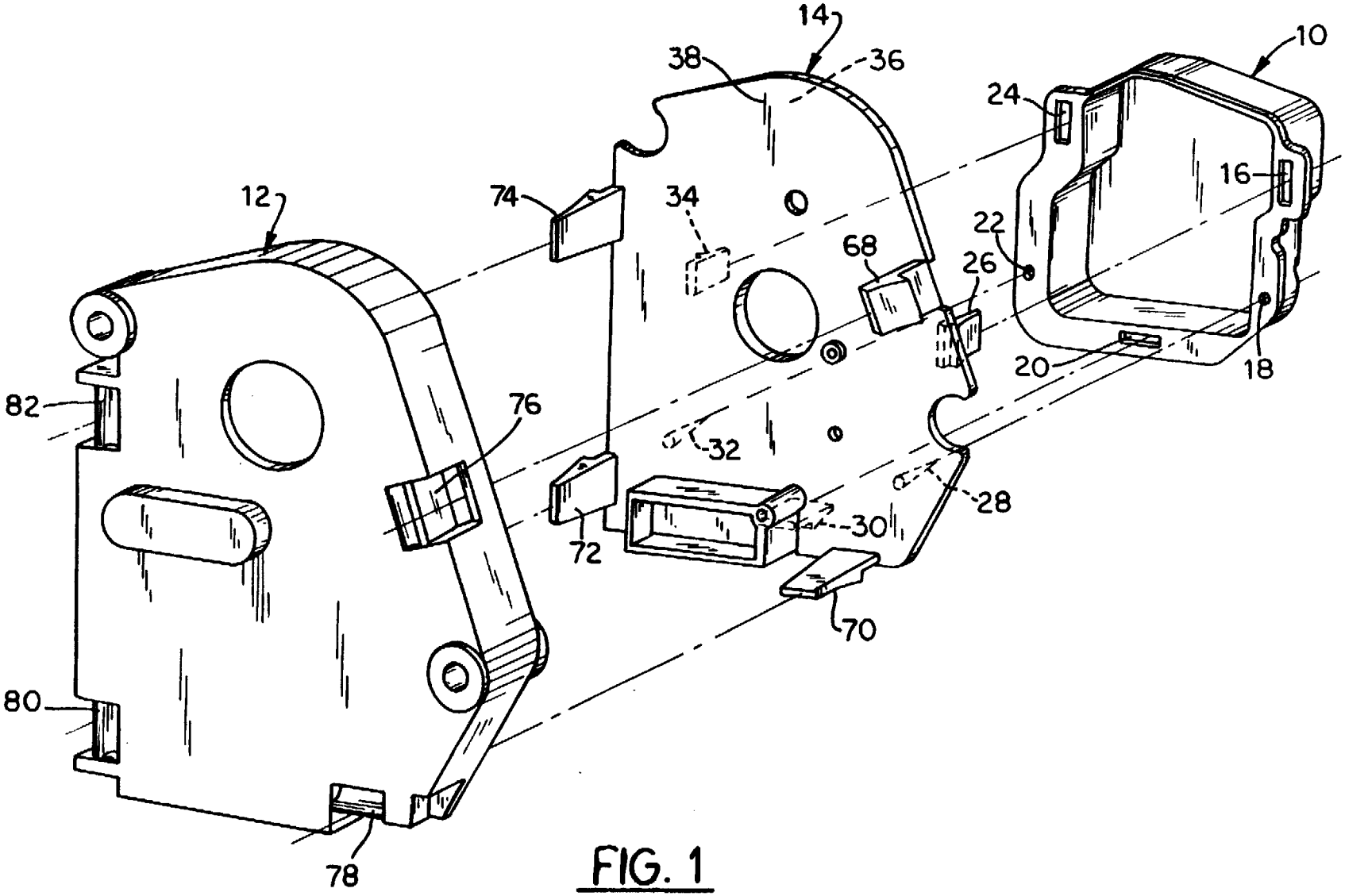
FIG. 1 is an exploded view of the housings and intermediate plate of an electrical timer.

Before explaining at least one embodiment of the invention in detail it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purpose of description and should not be regarded as limiting.

DETAILED DESCRIPTION OF THE PREFERRED EMBODIMENTS

FIG. 1 discloses the shell of the timer having a first and second housings 10 and 12 (called "motor" and "cam" housings, respectively) and an intermediate plate 14 enclosing respective open ends of each housing.

Motor housing 10 has five receivers 16–24 for receiving and engaging fastener fingers 26–34 extending from intermediate plate 14. The inwardly facing surfaces of these receivers are adapted to contact the fastener fingers and to hold the motor housing in proper alignment with intermediate plate 14. Intermediate plate 14 is substantially planar, having two laterally extending sides 36 and 38, side 36 facing and enclosing motor housing 10, and the second side 38 facing and enclosing cam housing 12. Five fastener fingers 26–34 extend from side 36 of the plate facing motor housing 10. These are adapted to be received and engaged by five receivers 16–24 on the motor housing. Three of these fastener fingers 26, 30 and 34 have catches (or "heads") near their free ends. These catches "catch" a surface of motor housing 10 and thereby prevent intermediate plate 14 from being removed from the cover. The catches may be integrally formed with fastener fingers 26, 30 and 34. Alternatively, they may be formed from, or attached to, the fastener fingers after the fastener fingers are received by receivers 16, 20 and 24.

Figure 2A:
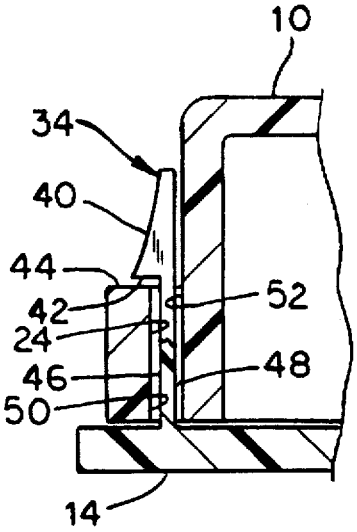
FIGS. 2A–C are cutaway views of several embodiments of fastener fingers for the timer of FIG. 1.
Figure 2B:
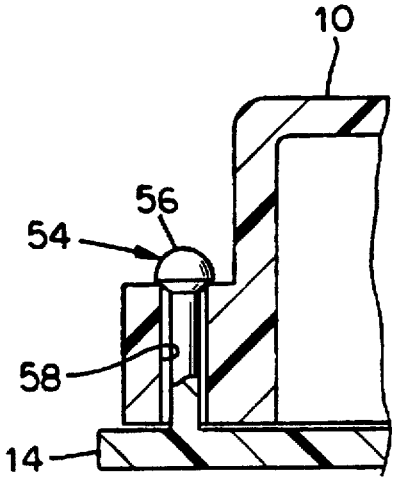
Figure 2C:
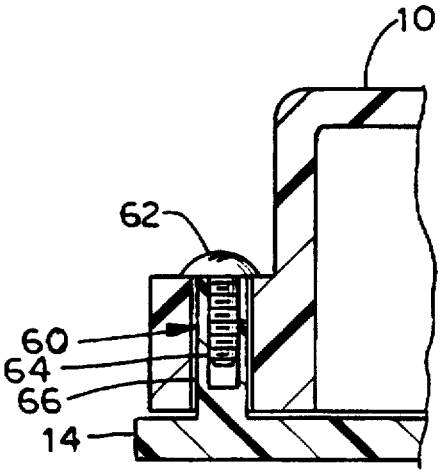

FIGS. 2A–C shows several different forms of fastener fingers with heads. The fastener finger 34 in FIG. 2A has a head 40 integrally formed near its free end, that provides a locking edge 42 extending from one side of fastener finger 34. This locking edge interferes with surface 44 of receiver 24, preventing housing 10 from being separated from intermediate plate 14. Edges 46 and 48 of fastener finger 34 interfere with inner surfaces 50, 52 (respectively) of receiver 24 holding housing 10 in alignment with intermediate plate 14. In FIG. 2B, fastener finger 54 is substantially circular in cross-section with a substantially hemispherical head 56 typically formed by melting the free end of the fastener finger after insertion into receiver 58. In FIG. 2C, fastener finger 60 has a head 62 similar to head 56 in FIG. 2B, but is attached to the shaft of fastener finger 60 by threaded extension 64 extending from head 62 into the shaft 66 of fastener finger 60.

Referring back to FIG. 1, four fastener fingers 68–74 extend from side 38 of plate 14, which faces the cam housing. These fingers are adapted to be received and engaged by corresponding receivers 76–82 in cam housing 12, and may be formed similarly to the examples in FIGS. 2A–C.

Figure 3:
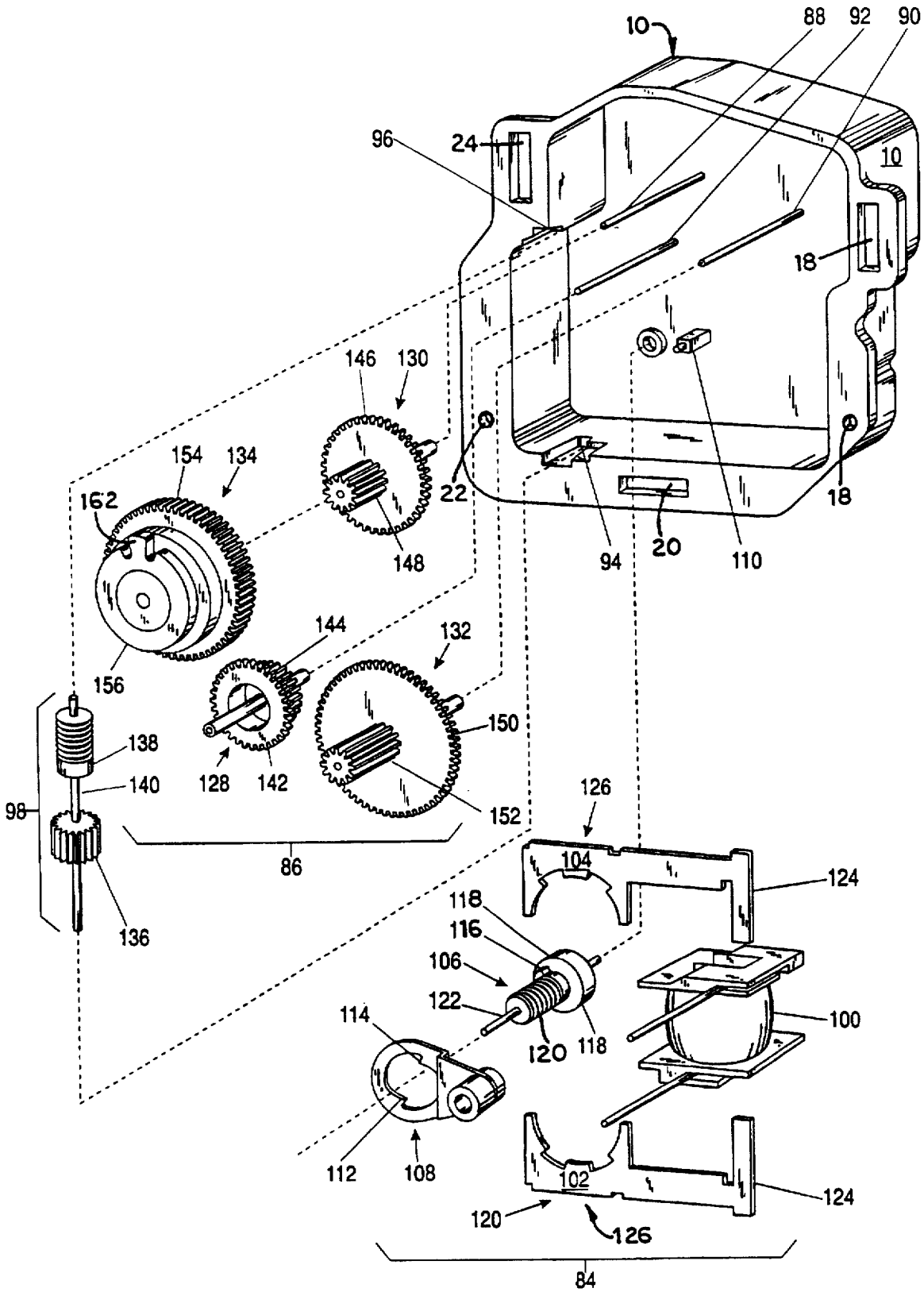
FIG. 3 is an exploded view of the components inside the motor housing of the FIG. 1 timer.

FIG. 3A is an exploded view of motor 84 and gear train 86 disposed in motor housing 10. Three gear shafts 88, 90 and 92 are fixed to the bottom of motor housing 10 and have free ends that extend upwards toward the intermediate plate 14 (FIG. 1). These shafts are adapted to support and guide gear train gear assemblies. Two gear shaft saddles 94 and 96 are formed in the inside surface of the motor housing to support the shaft of worm gear assembly 98 in an orientation substantially parallel to the intermediate plate 14. Motor 84, operated by a 120 VAC power source, includes a coil 100, two pole pieces 102 and 104, an armature 106 and a no-backup lever 108. No-backup lever 108 is rotationally supported by no-backup shaft 110 extending from the bottom of motor housing 10 toward intermediate plate 14. This lever has two teeth 112 and 114 that surround and engage no-backup cam 116 on armature 106. Armature 106 is capable of rotating in either direction at a speed of 720 RPM. It is provided with a permanent magnet 118 that forms the body of the armature, no-backup cam 116, and worm gear 120 concentric with the armature shaft 122.

No-backup cam 116 has a tooth that engages the teeth on no-backup lever 108 when motor 84 is energized, and insures that the motor rotates in only one direction. When armature 106 turns in the correct direction, no-backup lever teeth 112 and 114 and armature cam 116 do not engage, and armature 106 rotates freely. Each of pole pieces 102 and 104 has a coil end 124 and an armature end 126. The coil ends 124 extend into the center of coil 100 and are magnetically linked by the coil's oscillating field generated when the coil is energized. An alternating magnetic field is thereby developed in pole pieces 102 and 104, making each armature end 126 of the pole pieces alternately a north magnetic pole and a south magnetic pole. Armature ends 126 of pole pieces 102 and 104 extend toward armature 106, wrapping around the armature's permanent magnet 118 to allow a magnetic linkage and a torque to be developed about armature shaft 122. This torque provides the motive power for rotating armature 106 and hence the rest of gear train 86.

Gear train 86 includes worm gear assembly 98 and three spur gear assemblies 128, 130 and 132, and a geneva drive gear assembly 134. Each of these assemblies includes two gears that are rotatably fixed with respect to each other. Gear assemblies 128–134 are rotationally supported by shafts 88, 90 and 92 extending from the bottom of motor housing 10. This gear train provides a gear reduction of 34,560:1, from an armature speed of 720 RPM to a geneva drive gear speed of 1/48 RPM.

Worm gear assembly 98 comprises spur gear 136 and worm gear 138 coaxially mounted on shaft 140. Both spur gear 136 and worm gear 138 are fixed on shaft 140 and therefore rotate together at the same speed. The ends of the shaft are rotatably supported in gear shaft saddles 94 and 96 formed in motor housing 10.

Spur gear 136 in worm gear assembly 98 engages worm gear 120 in armature 106. Thus when armature 106 rotates, it causes worm gear assembly 98 to rotate as well. The gear ratio between these two gears is 18:1, and gears 136 and 138 rotate at 40 RPM.

Spur gear assembly 128 includes two spur gears 142 and 144 rotating about shaft 92. Gears 142 and 144 are rotatably supported by shaft 92 and are rotatably fixed with respect to each other. Thus, both gears rotate together at the same speed. Gear 142 is engaged with worm gear 138 of worm gear assembly 98. Thus, when motor 84 turns worm gear 138, as described above, gear 142 also rotates. The gear ratio between worm gear 138 and spur gear 142 is 32:1, and gears 142 and 144 rotate at 1.25 RPM.

Spur gear assembly 130 includes two spur gears 146 and 148 rotating about shaft 88. Gears 146 and 148 are rotatably supported by shaft 88 and are rotatably fixed with respect to each other. Thus, both gears rotate at the same speed. Gear 146 is engaged with gear 144 of spur gear assembly 128. Thus, when motor 84 turns gear 144, as described above, gear 146 also rotates. The gear ratio between gear 144 and gear 146 is 2:1 and gears 146 and 148 rotate at 0.625 RPM.

Spur gear assembly 132 includes two spur gears 150 and 152 rotating about shaft 90. Gears 150 and 152 are rotatably supported by shaft 90 and are rotatably fixed with respect to each other. Thus, both gears rotate at the same speed. Gear 150 is engaged with gear 148 of spur gear assembly 130. Thus, when motor 106 turns gear 148, as described above, gear 150 also rotates. Since gears 150 and 152 are rotatably fixed with respect to each other, gear 152 will also rotate. The gear ratio between gear 148 and gear 150 is 5:1, and gears 150 and 152 rotate at 0.125 RPM.

Geneva gear assembly 134 includes spur gear 154 and geneva driver gear 156 rotating about shaft 88. Gears 154 and 156 are rotatably supported by shaft 88 and are rotatably fixed with respect to each other. Thus, both gears rotate at the same speed. Gear 154 is engaged with gear 152 of spur gear assembly 132. Thus, when motor 84 turns gear 152, as described above, gear 154 also rotates. Since gears 154 and 156 are rotatably fixed with respect to each other, gear 156 will also rotate. The gear ratio between gear 154 and gear 152 is 6:1 and gears 154 and 156 therefore rotate at 1/48 RPM.

Figure 4B:
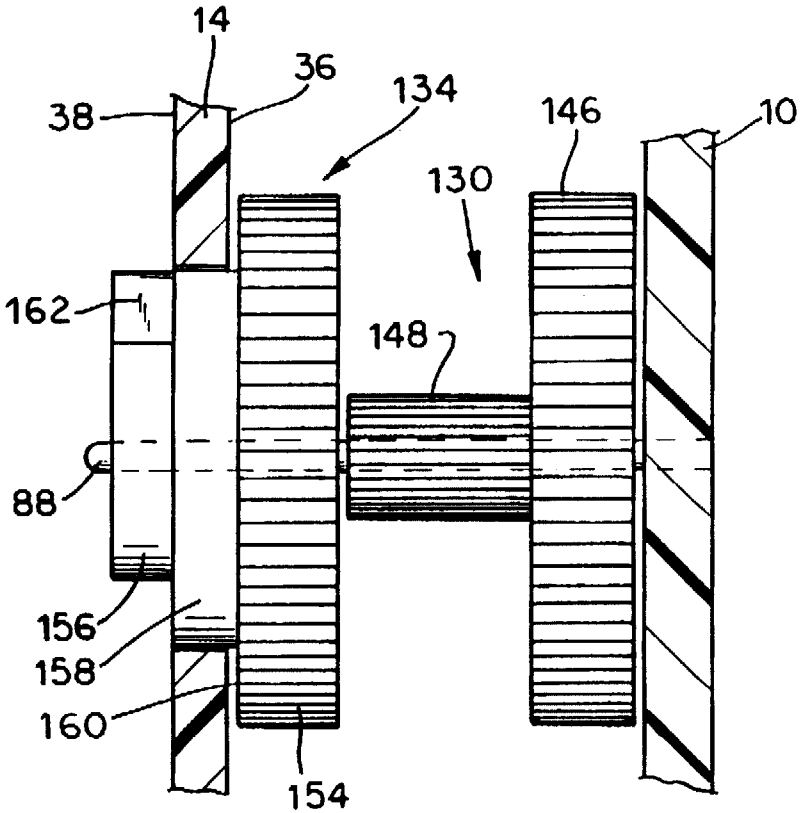
FIGS. 4A and B are top and side views of the geneva gear assembly of the FIG. 1 timer and the intermediate plate in which it is mounted.
Figure 4A:
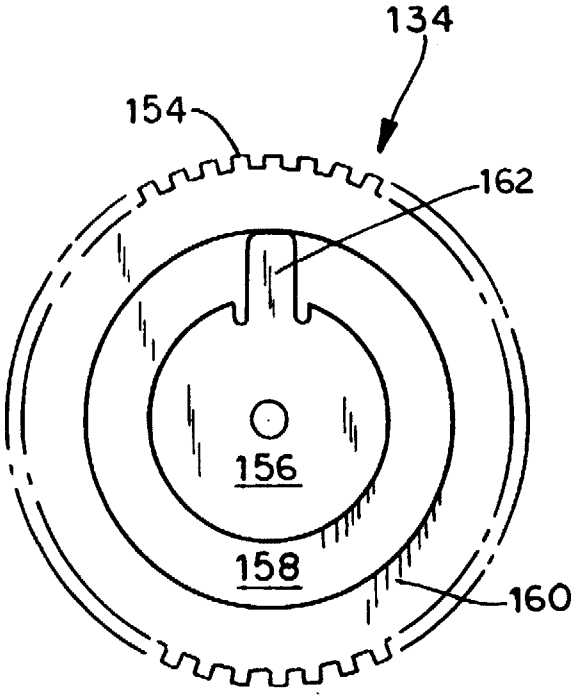

FIGS. 4A and B illustrate geneva gear assembly 134 in top and side views. In addition to spur gear 154 and geneva drive gear 156, assembly 134 also includes cylindrical thrust bearing 158 disposed between and integral with gears 154 and 156. As seen in FIG. 4B, gear assembly 134 extends through intermediate plate 14 (shown in cross-section in FIG. 4B) such that geneva drive gear 156 is disposed on side 38 of intermediate plate 14, and spur gear 154 is disposed on side 36 of intermediate plate 14. Gear assembly 134 is maintained in position by gear assembly 130 disposed on common shaft 88, and by shoulder 160, which abuts plate 14, and prevents assembly 134 from being removed from the end of shaft 88.

Cylindrical thrust bearing 158 relieves extreme loads that would otherwise be placed on shaft 88 and prevents shaft 88 from being bent or deflected. Thrust bearing 158 has an outside diameter smaller than that of spur gear 154 and at least as large as that of geneva drive gear 156. The radius of geneva drive gear 156 is measured from the axis of rotation to the outermost extent of lobe 162 of the gear. By providing a thrust bearing smaller than the diameter of gear 154, the geneva wheel/thrust bearing/gear combination is maintained within the motor housing by the intermediate plate when the cam housing is removed.

Figure 5:
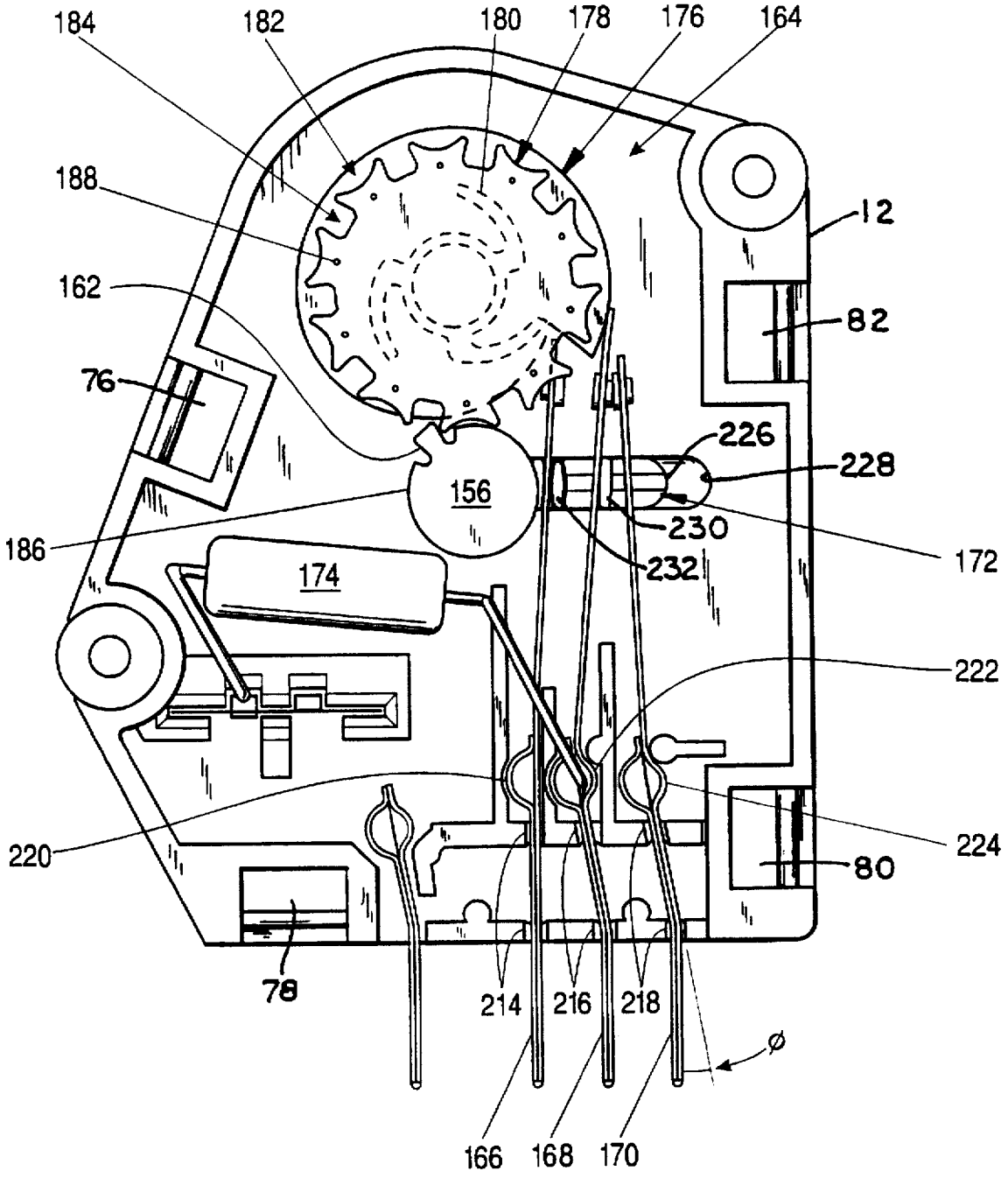
FIG. 5 is a plan view of the cam housing of the FIG. 1 timer and its internal components.
Figure 6:
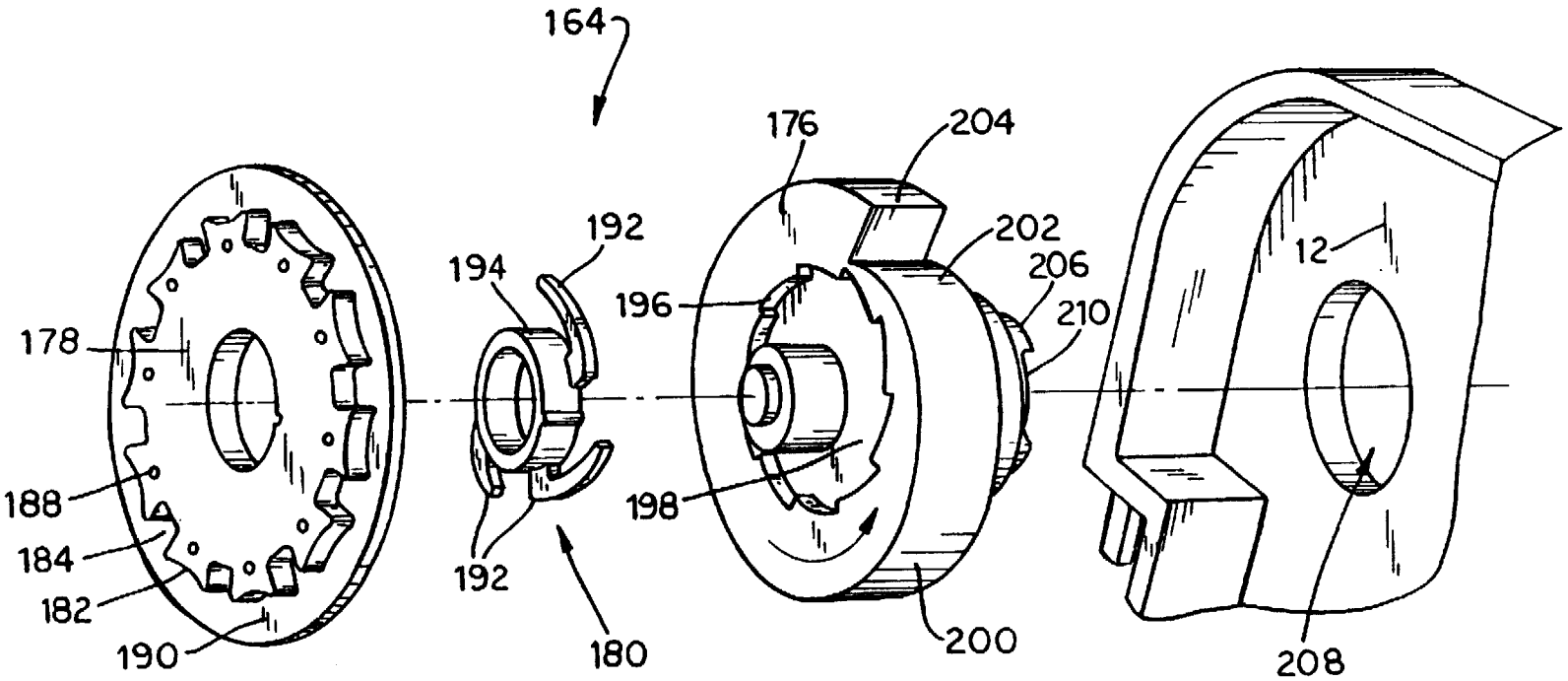
FIG. 6 is an exploded view of the geneva wheel/clutch/cam assembly of the FIG. 1 timer.

FIG. 5 illustrates a top view of cam housing 12, which surrounds and supports cam assembly 164, elongate switch members 166, 168 and 170, switch separator 172, and resistor 174. In this view, intermediate plate 14 has been removed, along with motor housing 10 to provide a clearer view of cam housing 12 and its contents. Cam assembly 164 includes cam 176, geneva wheel 178, and clutch 180. Lobe 162 of geneva drive gear 156 (shown here in cutaway) engages and rotates wheel 178, which rotates clutch 180, which rotates cam 176, which, in turn, makes and breaks the contacts between switch members 166, 168 and 170. Clutch 180 couples wheel 178 and cam 176 such that they both rotate about the same axis at the same speed when wheel 178 is driven by gear 156 as shown in FIG. 6 below.

Geneva wheel 178 has ten cusps 182 separated by ten radial slots 184. Each of these slots is engaged, in turn, by lobe 162 of gear 156. Thus, geneva wheel 178 makes one rotation for every ten rotations of gear 156, and thus the average speed of geneva wheel 178 is one tenth that of gear 156, or 1/480 RPM or eight hours per rotation. Geneva wheel 178, however, is actually in motion only when lobe 162 is engaged with one of the slots and is rotating. It remains stationary when the semi-cylindrical portion 186 of gear 156 engages the concave portion of each of cusps 182. Thus, wheel 178 starts and stops with each rotation of gear 156, moving a predetermined number of degrees (in this case 36 degrees) during that portion of each gear 156 revolution in which lobe 162 is engaged with one of the slots. Each of these motion cycles is referred to herein as a "geneva motion cycle" or a "geneva cycle". Since wheel 178 is therefore stationary for about 270 degrees of rotation of gear 156, the instantaneous speed of wheel 178 during a geneva cycle is significantly greater than the average speed of wheel 178.

Wheel 178 therefore makes a single revolution about its axis in a series of ten geneva cycles. Each cycle is equivalent to 36 degrees of rotation of wheel 178. In contrast to the intermittent motion of gear 178, gear 156 which is connected through a gear train to motor 84 (FIG. 3), has a substantially constant speed of rotation of 1/48 RPM. During about 90 degrees of each revolution of gear 156, lobe 162 engages a slot on wheel 178 and rotates wheel 178. Thus, wheel 178 is stationary about 75% of the time (270 degrees of gear 156 rotation) and spends about 25% of the time in step-wise rotation.

Each cusp 182 has a nipple 188 on its uppermost surface. When the timer is assembled, these nipples contact side 38 of intermediate cover 14—the side facing and enclosing cam housing 12. These nipples space wheel 178 away from plate 14, reduce the surface area of wheel 178 in contact with plate 14, and thereby reduce the rotational friction between plate 14 and wheel 178.

FIG. 6 illustrates an exploded view of cam assembly 164, illustrating cam 176, wheel 178 and clutch 180. Flange 190 is provided on the opposite side of wheel 178 from the nipples that extend outwardly beyond the cusps of wheel 178, and describes a circle at its outermost extent. When the timer is assembled, this flange extends over the end of gear 156 and controls the end play of gear 156 (FIG. 5). Clutch 180, adjacent to wheel 178, couples wheel 178 to cam 176. The clutch includes a set of three clutch fingers 192 extending from the center of clutch hub 194 that flexingly engage ten clutch teeth 196 formed in clutch cavity recess 198 in cam 176. Clutch hub 194 is keyed to fit into a keyed recess in wheel 178 such that fingers 192 always rotate with wheel 178 during operation of the timer. Alternatively, fingers 192 can be integrally molded with wheel 178. Recess (or "clutch cavity") 198 receives clutch fingers 192, which flex and allow manual rotation of cam 176 with respect to wheel 178 when cam 176 is rotated in a first rotational direction (shown here by the directional arrow on cam 176), and oppose the rotation of cam 176 with respect to wheel 178 when the cam is rotated in the other rotational direction. The ten teeth 196 disposed in clutch cavity 198 are evenly spaced about the inside surface of the clutch cavity at 36 degree intervals, equivalent to the angular interval of each cusp on wheel 178.

Cam surface 200 is in the form of a spiral ramp, rising from a lowermost point 202 (i.e. closest to the axis of rotation of the cam), to an uppermost point 204 (i.e. the point on cam 176 farthest from its axis of rotation). Cam 176 rotates with wheel 178 coupled by clutch 180 in the direction indicated by the directional arrow on cam 176. Cam 176 abuts the bottom of cam housing 12 and one axial end 206 of the cam extends through a hole 208 in the bottom of cam housing 12. End 206 has a notch 210 that allows the cam to be manually engaged and rotated by a tool such as a screwdriver, typically for testing the timer. When cam 176 is so rotated, clutch fingers 192 are flexed inwardly by the ramped surfaces of teeth 196. Clutch teeth 196 are evenly spaced, and thus, after a manual cam rotation of 36 degrees, the clutch fingers snap outward and engage the next set of clutch teeth. In this manner, the cam can be advanced 36 degrees at a time with respect to the wheel, an angle equivalent to a single cusp of wheel 178. In this manner, the position of the uppermost point 204 of the cam surface 200 is kept in a fixed (though indexably advanceable) relationship with the cusps of wheel 178. During such manual rotation of the cam, due to the clutch's resistance to such rotation, wheel 178 tends to rotate as well. As a result, significant forces may be applied by geneva wheel 178 to geneva drive gear 156 (not shown). Thrust bearing 158 on geneva drive gear assembly 134 resists this force, preventing gear 156 from flexing and maintaining it in engagement with wheel 178, thus preventing wheel 178 from rotating with cam 176.

Referring back to FIG. 5, three switch members 166, 168 and 170 are disposed in cam housing 12. These members are electrical conductors, and have electrical contacts disposed on the ends nearest to cam 176. The other ends of these members are supported by slots 214, 216 and 218 in cam housing 12 that prevent the members from rotating or translating. These slots pass entirely through the side of cam housing 12 and allow a portion of the members to extend beyond the cam housing. In this manner, the members may be electrically coupled to external devices to connect those devices to and disconnect those devices from electrical power. Each member is made of a conductive material such as copper or bronze that is bent double at the end of the member extending outside the cam housing. Each member is flared outward to form receivers 220, 222 and 224 that receive and electrically couple a conductor to that member. Inside cam housing 12 members 168 and 170 are bent toward cam 176 at an angle $\phi$ of between 5 and 15 degrees to provide optimum spacing between each of the members in proximity to cam 176.

FIGS. 7A–D show how members 166, 168 and 170 are actuated by cam surface 200. Wheel 178 (here shown cut-away) is engaged to cam 176 via the clutch (not shown). At this stage, cam 176 is stationary, since lobe 162 of gear 156 is not engaged with any of the cusps of cam 176. Switch member 166 is slightly flexed in contact with cam surface 200 at lowermost point 202, and makes electrical contact with member 168 through their respective contacts. Member 170 is held apart from members 166 and 168 by switch separator 172. Switch separator 172 includes an elongate portion 226 slidingly supported in groove 228 in the bottom of cam housing 12. It further has two elongate fingers 230 and 232 that are coupled to elongate portion 226 and extend upward, substantially perpendicular to the bottom of cam housing 12. Fingers 230 and 232 are disposed between members 166 and 168 and between members 168 and 170, respectively. Switch separator 172 thereby serves to prevent member 168 from simultaneously contacting both member 166 and member 170. The three switch members therefore form a single-pole, double-throw switch. In one switch position (shown here), members 166 and 168 make contact, and member 170 makes no contact. This switch position exists for about 355 degrees of cam rotation. In a second switch position (FIG. 7C), members 168 and 170 make contact, and member 166 makes no contact. This position exists for only a fraction of the period of rotation of the cam: when the end of member 166 is supported by lowermost point 202 of the cam and the end of member 168 is supported by uppermost point 204 of the cam.

Figure 7A:
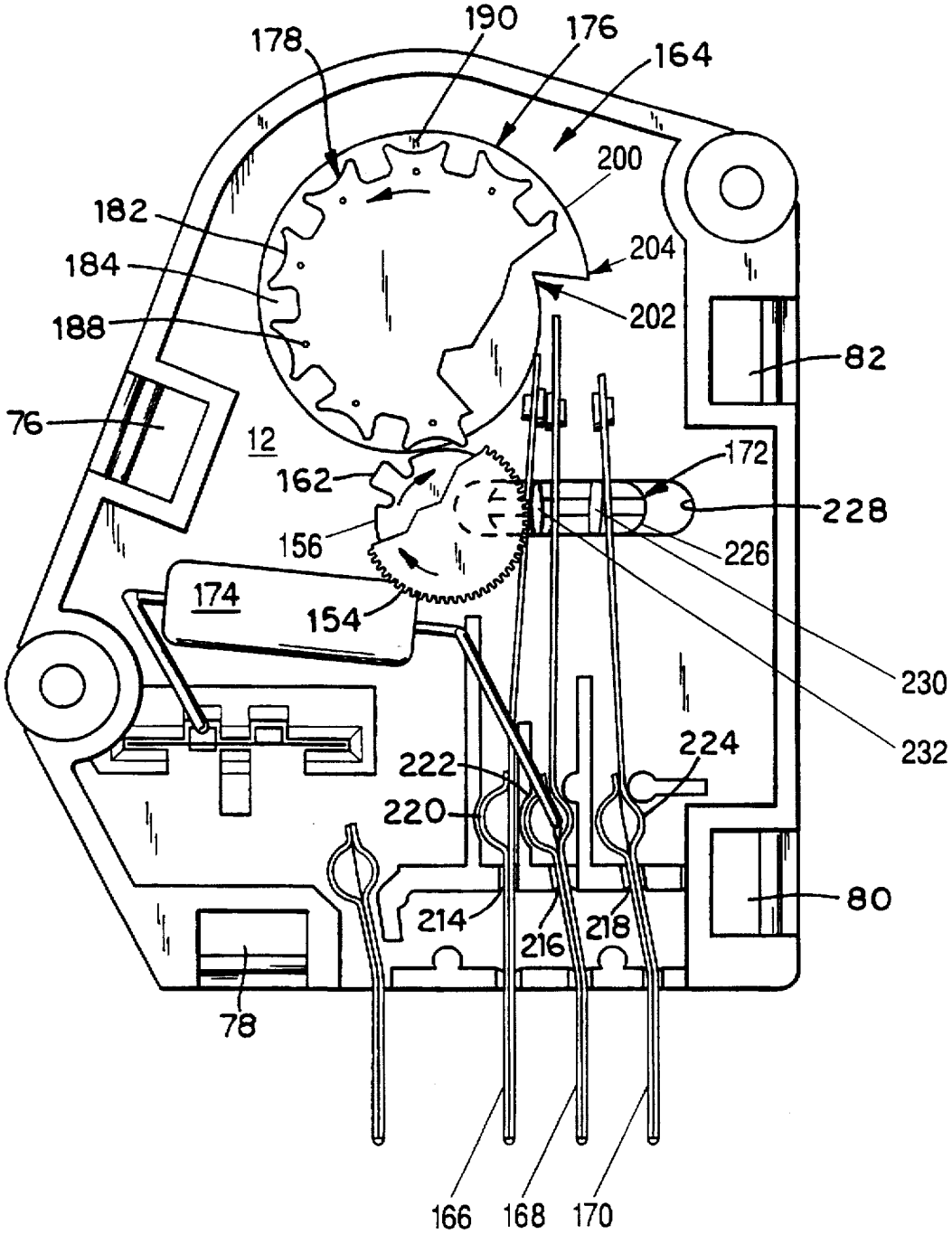
FIGS. 7A–7D are successive views of the cam housing and its internal components during the operation of the FIG. 1 timer.
Figure 7B:
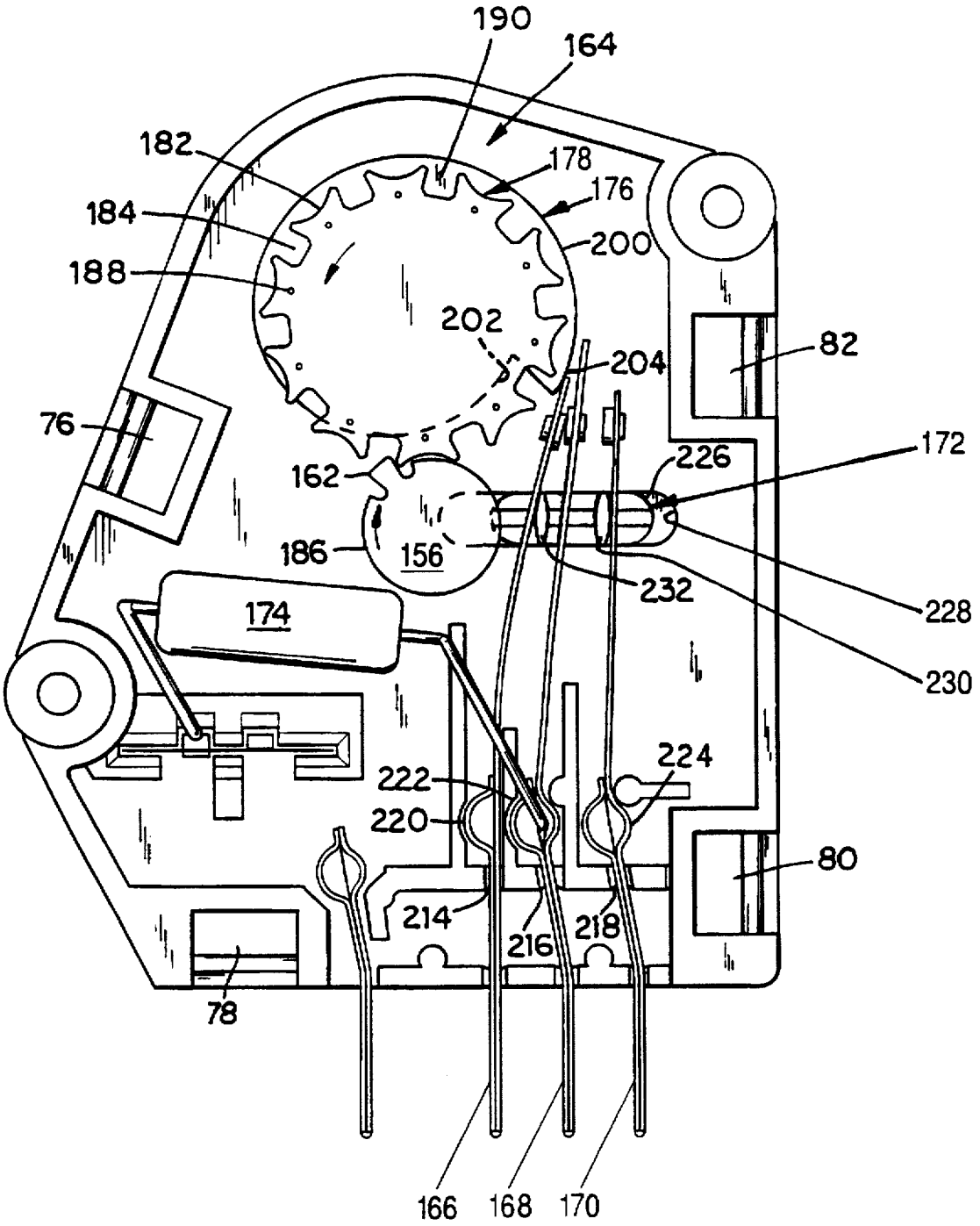

FIG. 7B, illustrates the FIG. 7A embodiment after nine complete revolutions of wheel 178 (i.e. nine geneva motion cycles). During these nine cycles, nine cusps of wheel 178 have been indexed by gear 156. In this figure, cam 176 has just started moving since lobe 162 of gear 156 has just contacted wheel 178. During the previous nine geneva motion cycles, member 166 has been gradually flexed away from the axis of cam 176 until it rests, as shown here, on the uppermost point of cam 176. As in FIG. 7A, member 168 is still in electrical contact with member 166. Member 166 has been gradually flexed away from the axis of cam 176 by cam surface 200 as cam 176 rotated. As member 166 flexed, it translated finger 222 rightwardly, and thereby translated switch separator 172 rightwardly in groove 228. Consequently, finger 230 and member 170 also moved rightwardly, maintaining member 170 separate from members 166 or 168. Consequently, during the last nine revolutions of wheel 178, there has been no change in the electrical connections between members 166, 168 and 170.

Figure 7C:
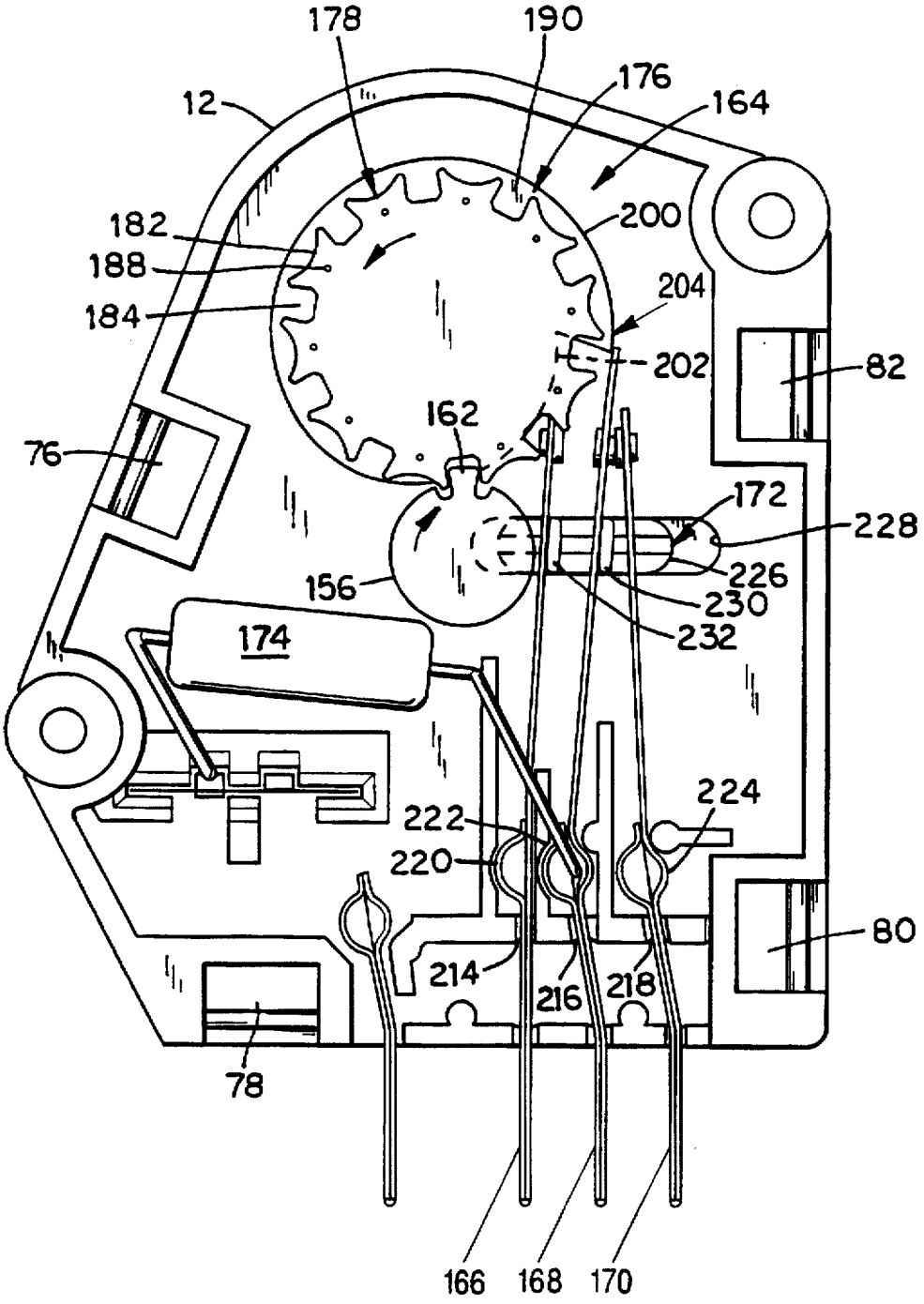

FIG. 7C illustrates the position of members 166, 168 and 170 after approximately 5 degrees of additional rotation of wheel 178. Note that lobe 162 is disposed in slot 184 of wheel 178, thus indicating that wheel 178 is in motion, since gear 156 rotates incessantly. At this point, member 166 has travelled past the uppermost point 204 of cam surface 200 and has snapped back toward the rotational axis of cam 176 toward the lowermost point 202 of cam surface 200. Since member 168 extends further around the cam surface than member 166, it has not yet been released by cam surface 200. It is in contact with and is supported in flexure by uppermost point 204 of cam surface 200. Since members 166 and 168 have become separated, the electrical connection between members 166 and 168 has been broken, and an electrical connection between members 168 and 170 has been made.

Figure 7D:
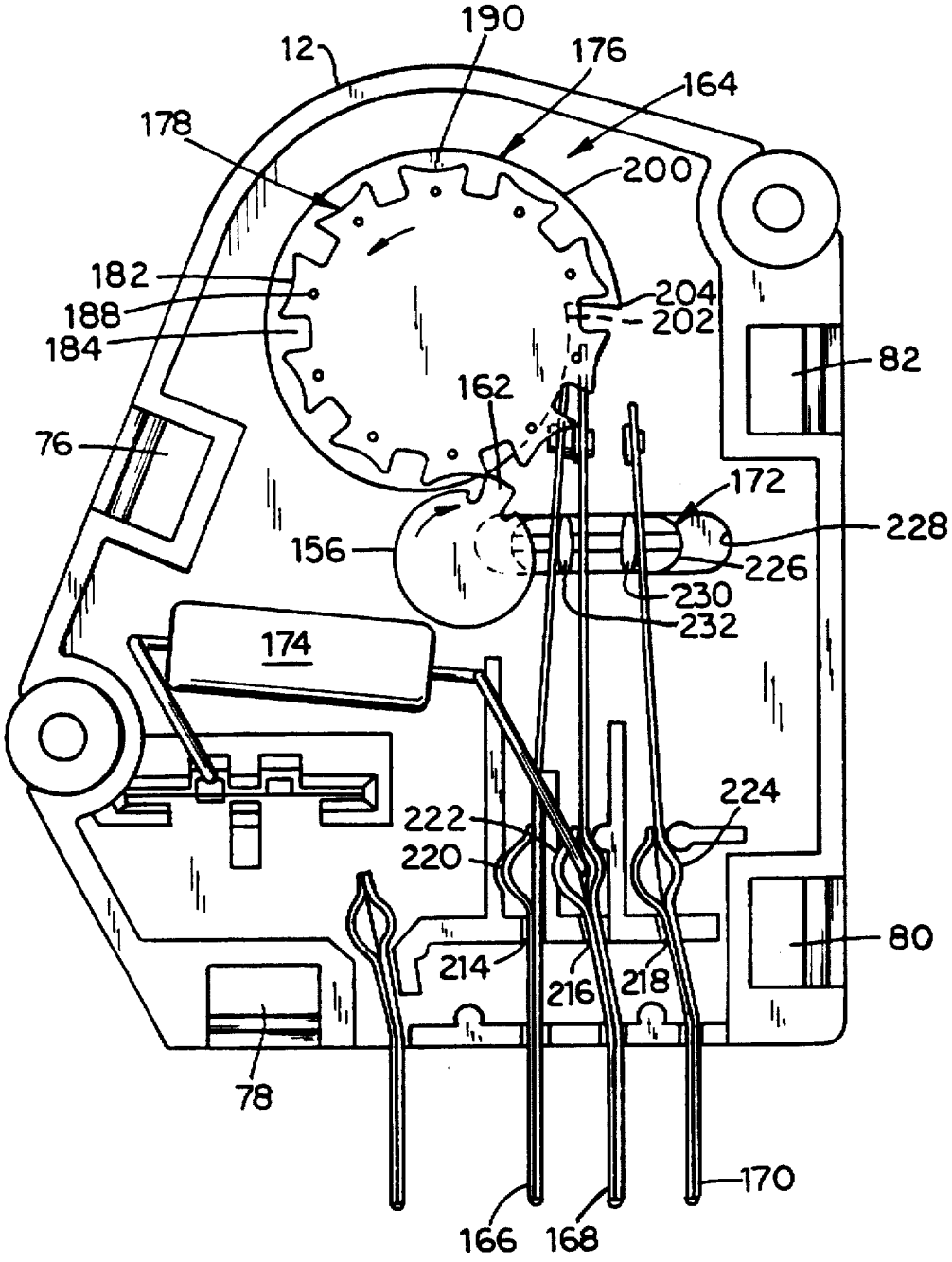

FIG. 7D illustrates the embodiment of FIG. 7C after a few degrees additional rotation of gear 156 and wheel 178. Note that lobe 162 has advanced approximately 12 degrees with respect to its position in FIG. 7C, and has advanced wheel 178 (and hence cam 176) an additional 5 degrees. Cam 176 and wheel 178 have just stopped at the end of the tenth geneva motion cycle, as shown by the fact that lobe 162 has just moved out of slot 184. During this last portion of the tenth geneva motion cycle, member 168 reached the uppermost point 204 of cam surface 200 and was released. Just as member 166 which preceded it in the motion cycle, member 168 has flexed back toward the axis of rotation of cam 176. Note that member 168 no longer makes electrical contact with member 170.

In FIGS. 7C and 7D, two switch events occurred during a single cycle of the geneva mechanism. These events were caused by the successive release of switch member 166 (FIG. 7C) and switch member 168 (FIG. 7D). During the first event, switch member 166 was released from the uppermost point of the cam, breaking the electrical connection between members 166 and 168, and making the connection between members 168 and 170. During the second event, switch member 168 was released from the uppermost point of the cam, breaking the electrical connection between members 168 and 170, and making the electrical connection between members 166 and 168. These events occurred in a single geneva motion cycle, separated by about 12 degrees of gear 156 rotation. Given the 1/48 RPM speed of gear 156, these events both occurred within about 2 minutes.

The timing of the geneva cycle with respect to the cam position relative to members 166 and 168 is critical to maintain this timing relationship. If the cam motion was slightly skewed with respect to the geneva cycle, and the two switch events occurred not in the same geneva cycle, but in two successive geneva cycles, the time between the events would be quite different. In this scenario, wheel 178 and cam 176 would stop after member 166 was released, and lobe 162 would have to make an almost complete revolution before engaging slot 184, rotating wheel 178 and cam 176, and releasing member 168. This additional 280 degrees of gear 156 rotation (at 1/48 RPM) would add about 47 minutes to the time between the first and second switch events.

Since cam 176 may be indexed manually with respect to wheel 178, such an error might easily be introduced. The particular design of this embodiment prevents this error, however, by maintaining cam 176 and wheel 178 in a constant angular relationship no matter how cam 176 is manually indexed. The clutch joining wheel 178 and cam 176 is provided with successive indexable positions that vary by multiples of 36 degrees, or one geneva motion cycle. Cam 176 can therefore be advanced with respect to wheel 178 only by an integral number of geneva motion cycles. In this embodiment this is provided by having clutch teeth spaced an angular distance apart equal to the angular displacement of a single geneva cycle, i.e. the angular displacement of a single cusp. Thus, no matter how far cam 176 is indexed relative to geneva wheel 178 by rotating cam 176 and advancing clutch fingers to adjacent clutch teeth, the relationship between the cusps and the cam remains fixed. Alternatively, fewer clutch teeth may be provided to allow the cam to be indexed an integral multiple of geneva motion cycles. In this manner, members 166 and 168 will always be released during a single geneva cycle. This benefit is provided by the linkage between geneva wheel 178 and cam 176.

Geneva wheel 178 and cam 176 share a common axis, and rotate together about that axis, linked by clutch 180 which also rotates about that axis. This design eliminates any gear train between the geneva wheel and the cam and consequently the risk of misaligning the cam with respect to the geneva motion cycle. Even if geneva wheel 178 and cam 176 are separated, such as might occur during repair of the timer, no matter how they are reassembled, the relationship between wheel 178 and cam 176 will remain the same on reassembly. This might not be the case if the geneva wheel did not rotate together with cam 176, but was separated by an intermediate gear train. In the event the geneva mechanism and the cam were so separated, any misassembly of such intermediate gears could easily introduce timing errors.

Thus, it should be apparent that there has been provided in accordance with the present invention a timer with improved geneva drive mechanism that fully satisfies the objectives and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. An electrical timer, comprising:

an electrical motor;

a gear train coupled to the electrical motor having a plurality of gears including a first geneva drive gear;

a geneva wheel having a plurality of cusps spaced a first angular distance apart coupled to the gear train;

a cam with a cam actuating surface; and a clutch coupling the geneva wheel to the cam wherein the clutch provides a plurality of indexable operating positions.

2. The electrical timer of claim 1, wherein each of the plurality of indexable operating positions is angularly displaced from adjacent ones of the plurality of indexable operating positions by a second angular distance equal to an integral multiple of the first angular distance.

3. The electrical timer of claim 2, wherein the geneva wheel, the clutch and the cam have a common rotational axis.

4. The electrical timer of claim 3, wherein the clutch includes a plurality of flexible arms integrally connected to the geneva wheel, and a plurality of detents disposed to receive the plurality of flexible arms and circumferentially disposed about a recess in the cam.

5. The electrical timer of claim 4, wherein the number of indexable operating positions equals the number of cusps on the geneva wheel.

6. The electrical timer of claim 5 further comprising a thrust bearing coupled to the geneva drive gear.

7. The electrical timer of claim 1, further comprising a plurality of switch members disposed to be actuated by the cam actuating surface.

8. The electrical timer of claim 7, wherein the cam actuating surface includes a first formation disposed to successively bias a first and a second of the plurality of switch members in respective first and second biasing events.

9. The electrical timer of claim 8, wherein the first and second biasing events occur in a single motion cycle of the geneva wheel.

10. The electrical timer of claim 1, further comprising:

a first housing disposed to receive and support the motor and gear train;

a second housing disposed to receive and support the geneva wheel, the cam and the clutch; and an intermediate plate having first and second sides, disposed to enclose the first housing with the first side of the plate and disposed to enclose the second housing with the second side of the plate; and a thrust bearing coupled to the geneva drive gear and rotationally supported by the intermediate plate.

11. The electrical timer of claim 10, wherein the thrust bearing has a radius at least as large as a distance from the outermost extent of one of an plurality of cusps and a rotational axis of the geneva wheel.

12. A switch comprising:

a geneva wheel having a rotational axis and disposed to rotate about the axis in a plurality of motion cycles separated by stationary periods;

a cam coupled to the geneva wheel; and a single-pole, double-throw switch disposed to be actuated by the cam wherein the cam and the geneva wheel have a common rotational axis and rotate at a common speed, and further wherein the cam is rotatable and indexably advanceable with respect to the geneva wheel in a rotatable index interval equal to the angular displacement of the geneva wheel in a single motion cycle.

13. The switch of claim 12, wherein the switch is twice thrown during one of the plurality of motion cycles.

14. The switch of claim 13, wherein the two switch throws are actuated by a single formation on the cam.

15. The switch of claim 14, wherein the switch is not thrown during any other of the plurality of motion cycles.

16. The switch of claim 15, further comprising a clutch having a clutch rotational axis and disposed to couple the geneva wheel and the cam.

17. The switch of claim 16, wherein the clutch includes:

a plurality of flexible fingers coupled to the geneva wheel and disposed about the clutch rotational axis; and a plurality of teeth coupled to the cam and disposed about the clutch rotational axis to engage the plurality of flexible fingers.

18. The switch of claim 17, wherein the angular displacement between adjacent ones of said teeth is equal to an angular displacement of a single geneva motion cycle.

19. The switch of claim 18, wherein the clutch rotational axis is the same as the geneva wheel rotational axis.

* * * * *